US011828533B2

(12) United States Patent
Zheng

(10) Patent No.: US 11,828,533 B2
(45) Date of Patent: Nov. 28, 2023

(54) DRYING APPARATUS BASED ON PERISTALTIC PROPELLING

(71) Applicant: AMCON (FUJIAN) ENVIRONMENT PROTECTION EQUIPMENT CO., LTD., Fuzhou (CN)

(72) Inventor: Chaozhi Zheng, Fuzhou (CN)

(73) Assignee: AMCON (FUJIAN) ENVIRONMENT PROTECTION EQUIPMENT CO., LTD., Fuzhou (CN)

( * ) Notice: Subject to any disclaimer, the term of this patent is extended or adjusted under 35 U.S.C. 154(b) by 78 days.

(21) Appl. No.: 17/545,241

(22) Filed: Dec. 8, 2021

(65) Prior Publication Data

US 2022/0099369 A1 Mar. 31, 2022

Related U.S. Application Data

(63) Continuation of application No. PCT/CN2019/100586, filed on Aug. 14, 2019.

(51) Int. Cl.

| | |
|---|---|
| ***F26B 17/10*** | (2006.01) |
| ***F26B 3/30*** | (2006.01) |
| ***F26B 15/18*** | (2006.01) |

(52) U.S. Cl.

CPC ..... *F26B 17/103* (2013.01); *F26B 3/30* (2013.01); *F26B 15/18* (2013.01)

(58) Field of Classification Search

CPC ..... F26B 17/103; F26B 3/30; F26B 15/18; F26B 17/26; F26B 2200/18; F26B 3/06

See application file for complete search history.

(56) References Cited

U.S. PATENT DOCUMENTS

| | | | | |
|---|---|---|---|---|
| 7,966,744 | B2 | 6/2011 | Kim | |
| 2016/0264896 | A1* | 9/2016 | Kim | F26B 17/04 |

FOREIGN PATENT DOCUMENTS

| | | | |
|---|---|---|---|
| CN | 102226637 | A | 10/2011 |
| CN | 204574734 | U | 8/2015 |
| CN | 105486065 | A * | 4/2016 |
| CN | 106629126 | A | 5/2017 |
| CN | 207262902 | U | 4/2018 |

(Continued)

OTHER PUBLICATIONS

Translation, CN-105486065-A (Year: 2016).*
Translation, DE-3712765-A1 (Year: 1988).*
Translation, WO-2009054033-A1 (Year: 2009).*

*Primary Examiner* — Jessica Yuen

(57) ABSTRACT

A drying apparatus based on peristaltic propelling, including a heat supply module, a drying chamber and a conveying device. The conveying device is arranged in the drying chamber. The drying chamber is provided with a heat source inlet, a heat source outlet, a feeding port and a discharging port. A heat output point of the heat supply module is arranged at the heat source inlet and is configured to provide heat to the drying chamber. The conveying device is configured to provide a platform for laying and propelling a material. The conveying device includes a platform formed by alternate stacking of at least two grid groups. A gap is provided between two adjacent grids. The gap is kept unobstructed and the material is flipped when the material is propelled forward. The gap formed between the adjacent movable grids facilitates improving the fluidity of the air, enhancing the drying efficiency.

10 Claims, 11 Drawing Sheets

(56) References Cited

FOREIGN PATENT DOCUMENTS

| | | | | | |
|---|---|---|---|---|---|
| CN | 108679997 | A | | 10/2018 | |
| CN | 108911471 | A | | 11/2018 | |
| DE | 3712765 | A1 | * | 3/1988 | |
| EP | 3165860 | A1 | * | 5/2017 | ..... F26B 15/18 |
| WO | WO-2009054033 | A1 | * | 4/2009 | ..... F26B 17/08 |

* cited by examiner

DRYING APPARATUS BASED ON PERISTALTIC PROPELLING

CROSS-REFERENCE TO RELATED APPLICATIONS

This application is a continuation of International Patent Application No. PCT/CN2019/100586, filed on Aug. 14, 2019. The content of the aforementioned applications, including any intervening amendments thereto, is incorporated herein by reference in its entirety.

TECHNICAL FIELD

The present disclosure relates to material drying apparatuses, and more particularly to a drying apparatus based on peristaltic propelling.

BACKGROUND

Drying apparatus has been widely used in drying process in the fields of chemical, food, medicine and building material. In the sludge treatment, a filter cake produced by a sludge dewatering machine falls freely on a net belt after being granulated or slivered, and then conveyed by the multi-layer net belt, where the moisture in the filter cake gradually evaporates during the conveying process, and a material with a lower water content is finally discharged.

Chinese Patent Application No. 201810369116.0 and Chinese Patent Application No. 201810953665.2 disclosed a drying apparatus based on return air circulation heating and a closed belt dryer, respectively, and both of them employed a net belt for material delivery, and had a heat source inlet arranged under a bottom of a drying chamber and an open discharging port.

Unfortunately, the above drying apparatuses in prior art has the following shortcomings.

(1) The drying efficiency will be extremely low when drying a filter cake with high water content that cannot be formed.

(2) The filter cake cannot be evenly spread in a short time after falling to the net belt, so that the stacked filter cake will even block meshes of a filter mesh, attenuating the effect of ventilation and evaporation.

(3) The shape of the filter cake will not change during the delivery process, and thus water in the filter cake cannot be removed. The bottom of the filter cake cannot be fully exposed to heat source, which results in an unevenness evaporation.

(4) The heat source only rises vertically from the bottom and no horizontal heat source is generated, resulting in a low evaporation efficiency for the filter cake on the net belt.

(5) The heat source will leak through the open discharging port, which increases the heat loss.

SUMMARY

An object of the disclosure is to provide an efficient drying apparatus based on peristaltic propelling to overcome the shortcomings of the prior art.

Technical solutions of this application are specifically described as follows.

A drying apparatus based on peristaltic propelling, comprising:

a heat supply module;

a drying chamber; and a conveying device;

wherein the conveying device is arranged in the drying chamber; the drying chamber is provided with a heat source inlet, a heat source outlet, a feeding port and a discharging port;

a heat output point of the heat supply module is arranged at the heat source inlet and is configured to provide a heat source for the drying chamber;

the conveying device is configured to provide a platform for laying and propelling a material to be dried; and a platform of the conveying device is formed by laying a plurality of main parts capable of generating relative local movement and displacement; a gap is provided between adjacent two main parts to allow air to pass through; and the plurality of main parts are configured to repeatedly flip the material to be dried to enable peristaltic propelling of the material to be dried and keep the gap unobstructed.

In some embodiments, each of the plurality of main parts comprises a conveying sub-platform; the conveying sub-platform is formed through alternate stacking of at least two groups of first grids; two adjacent first grids in the same group are separated by a gasket; and a thickness of the gasket is greater than that of first grids in another group of the at least two groups of first grids to form the gap;

the at least two groups of first grids comprise at least one movable grid group, and the at least one movable grid group is capable of generating relative displacement with respect to another group of the at least two grid groups, so as to enable the at least one movable grid group to reciprocate; and each movable grid of each of the at least one movable grid group is provided with at least two connecting holes respectively at front and rear balance positions; movable grids of each of the at least one movable grid group are connected to form a moving body through a connecting rod penetratedly arranged in the connecting holes; and the moving body is configured to guide and drive all movable grids of a corresponding movable grid group to move in the same trajectory through a drive device.

In some embodiments, the drive device comprises a drive central shaft group, a transmission gird group and a drive mechanism group;

the drive central shaft group comprises at least two drive central shafts;

the transmission gird group comprises at least two transmission girds respectively provided at left and right balance positions of the conveying sub-platform; each of the at least two transmission girds is provided with at least two eccentric devices at front and rear balance positions of the conveying sub-platform; one of the at least two drive central shafts is penetratedly provided in left-right corresponding eccentric devices of the transmission gird group; the eccentric devices of the transmission gird group have consistent eccentric direction and eccentric wheelbase; each of the at least two transmission girds is provided with at least two fixing holes; the at least two fixing holes are arranged respectively corresponding to the connecting holes of the movable grid group; and each of the at least two fixing holes and a corresponding connecting hole are fixedly connected through the same connecting rod;

the drive mechanism group comprises one drive motor and a transmission mechanism, or a plurality of drive motors; and the drive mechanism group is configured to drive the at least two drive central shafts of the drive central shaft group to rotate at the same rotation direction and rotation speed; and the drive mechanism group is configured to drive the at least two drive central shafts of the drive central shaft group to move synchronously, so as to drive the at least two transmission girds respectively sleeved on the at least two drive central shafts to move; and the transmission gird group is configured to drive one movable grid group connected with the transmission gird group to move in the same trajectory.

In some embodiments, the conveying sub-platform is formed through alternate stacking of two movable grid groups; the two movable grid groups are configured to share the same drive central shaft group.

In some embodiments, a lower platform is correspondingly provided below the platform of the conveying device; the lower platform is formed through alternate stacking of at least two groups of second grids; and a gap is provided between adjacent two second grids; and each of the at least one movable grid group of the platform of the conveying device is connected to a movable grid group of the lower platform through a plurality of lower guide connecting bars, such that the movable grid group of the lower platform and a corresponding movable grid group of the platform of the conveying device move in the same trajectory; and the plurality of lower guide connecting bars are evenly distributed on movable grids on two sides of each of the at least one movable grid group of the platform of the conveying device.

In some embodiments, a pressing device is arranged above the platform of the conveying device.

In some embodiments, the pressing device is a rotating device, and is placed above the at least one movable grid group of the platform of the conveying device to enable the material to be dried on the at least one movable grid group to be pressed by the rotating device when the at least one movable grid group moves up to a highest point, such that the material to be dried is flattened, pressed and scraped.

In some embodiments, the pressing device comprises at least one pressing plate; the at least one pressing plate is arranged above one of the at least one movable grid group of the platform of the conveying device through a plurality of upper guide connecting bars, such that the material to be dried is fully pressed by the plurality of upper guide connecting bars when another group of the at least one movable grid group moves up to a highest point, enabling the material to be dried to be flattened, pressed and scraped; and the plurality of upper guide connecting bars are balancedly arranged on movable grids on two sides of the one of the at least one movable grid group of the platform of the conveying device.

In some embodiments, the pressing device is a chain scraper;

the chain scraper is a scraping bar arranged on the transmission mechanism;

the transmission mechanism comprises at least two chains and at least four sprocket wheels; every two of the at least four sprocket wheels are arranged on one of the at least two drive central shafts; each of the at least two chains is wound on at least two of the at least four sprocket wheels; and the scraping bar comprises at least one scraping bar; the at least one scraping bar is provided on each of the at least two chains; the at least one scraping bar is located above the at least one movable grid group of the platform of the conveying device to enable the material to be dried on the at least one movable grid group of the platform of the conveying device to be fully scraped when the at least one movable grid group moves up to a highest point, such that the material to be dried is flattened, pressed and scraped; and when the number of the at least one scraping bar is equal to or larger than two, the at least one scraping bar is arranged spaced apart.

In some embodiments, the pressing device comprises a pressing grid group; the at least one movable grid group of the platform of the conveying device comprises a first movable grid group and a second movable grid group; the pressing grid group is connected above the platform of the conveying device through a plurality of upper guide connecting rods; the plurality of upper guide connecting rods are balancedly arranged on movable grids on two sides of the first movable grid group; the pressing grid group is driven to move by a movement of the first movable grid group; pressing grids of the pressing grid group are respectively aligned with gaps of the second movable grid group to enable the pressing grid group to scrape a side wall of the second movable grid group and press the material to be dried, such that the material to be dried is flattened, sheared, pressed and scraped.

In some embodiments, a scraping device is arranged below the platform of the conveying device; and the scraping device comprises a scraping grid group; the scraping grid group is connected below the platform of the conveying device through a plurality of lower guide connecting rods; the plurality of lower guide connecting rods are balancedly arranged on movable grids on two sides of the second movable grid group; the scraping grid group is driven by a movement of the second movable grid group to move; scraping grids of the scraping grid group are respectively aligned with gaps of the first movable grid group to enable the scraping grid group to scrape a side wall of the first movable grid group, such that the material to be dried is pressed and scraped.

In some embodiments, the conveying device comprises a plurality of conveying devices; the plurality of conveying devices are layeredly arranged in the drying chamber from top to bottom; and conveying directions of conveying devices of the plurality of conveying devices at adjacent layers are opposite, such that the material is conveyed from an initial end to a tail end of a conveying device at an upper layer, and then falls to an initial end of a conveying device at a lower layer and then is conveyed to a tail end of the conveying device at the lower layer, and so on.

In some embodiments, the feeding port is arranged above a conveying device of the plurality of conveying devices at an uppermost layer; and the discharging port is arranged below a conveying device of the plurality of conveying devices at a lowermost layer;

the heat source inlet is arranged at a side of the drying chamber and near the discharging port; the heat source outlet is arranged at the side of the drying chamber and near the feeding port; and a feeding direction of a heat source is opposite to a discharge direction of the material to be dried.

In some embodiments, a guide plate is arranged around the platform of the conveying device to guide the heat source to the platform of the conveying device.

In some embodiments, a slivering machine or a slicing machine is provided at the feeding port to enable the material to be evenly scattered to an initial end of the conveying device at the uppermost layer after being formed; and the slivering machine or slicing machine is configured to seal the feeding port to prevent the heat source from leaking through the feeding port.

In some embodiments, the discharging port is provided with a rotary feeder; and the rotary feeder is closed to prevent the heat source from leaking through the discharging port.

In some embodiments, a rotating block of the rotary feeder is a disk with gears; and the disk with gears is configured to be driven by another gear.

In some embodiments, the drying apparatus further comprises a heat source recycling device; the heat source recycling device is arranged in the drying chamber near the heat source outlet; and the heat source recycling device comprises a condenser and a guide fan, such that a part of heat source is guided by a pipeline and the guide fan to pass through the condenser to be dehumidified, and then to return to the drying chamber.

In some embodiments, an infrared heater is provided above the conveying device.

Compared to the prior art, the present disclosure has the following beneficial effects.

(1) In the conveying process of the material, gaps are formed among the movable grids, which improves the air fluidity.

(2) In the conveying process, an evaporation area of the material is increased by operations of propping up, flattening, shearing and scraping, which contributes to a more efficient drying, and makes the drying apparatus provided herein suitable for the treatment of materials with high moisture content that difficult to be formed.

(3) The material can fall down through the gap without causing blockage.

(4) A feeding direction of heat source is opposite to a discharge direction of the material. The heat source is horizontally introduced to the drying chamber, and then passes through the platform of the conveying device to be discharged through the heat source outlet, such that the heat source not only rises from the bottom of the platform of the conveying device, but also flows horizontally to remove the moisture, enhancing the evaporation efficiency.

(5) The discharging port is sealed to prevent the heat source from leaking therethrough, attenuating the heat loss and further enhancing the drying efficiency.

BRIEF DESCRIPTION OF THE DRAWINGS

The disclosure will be described in detail below with reference to the embodiments and accompanying drawings.

DETAILED DESCRIPTION OF EMBODIMENTS

Figure 1:
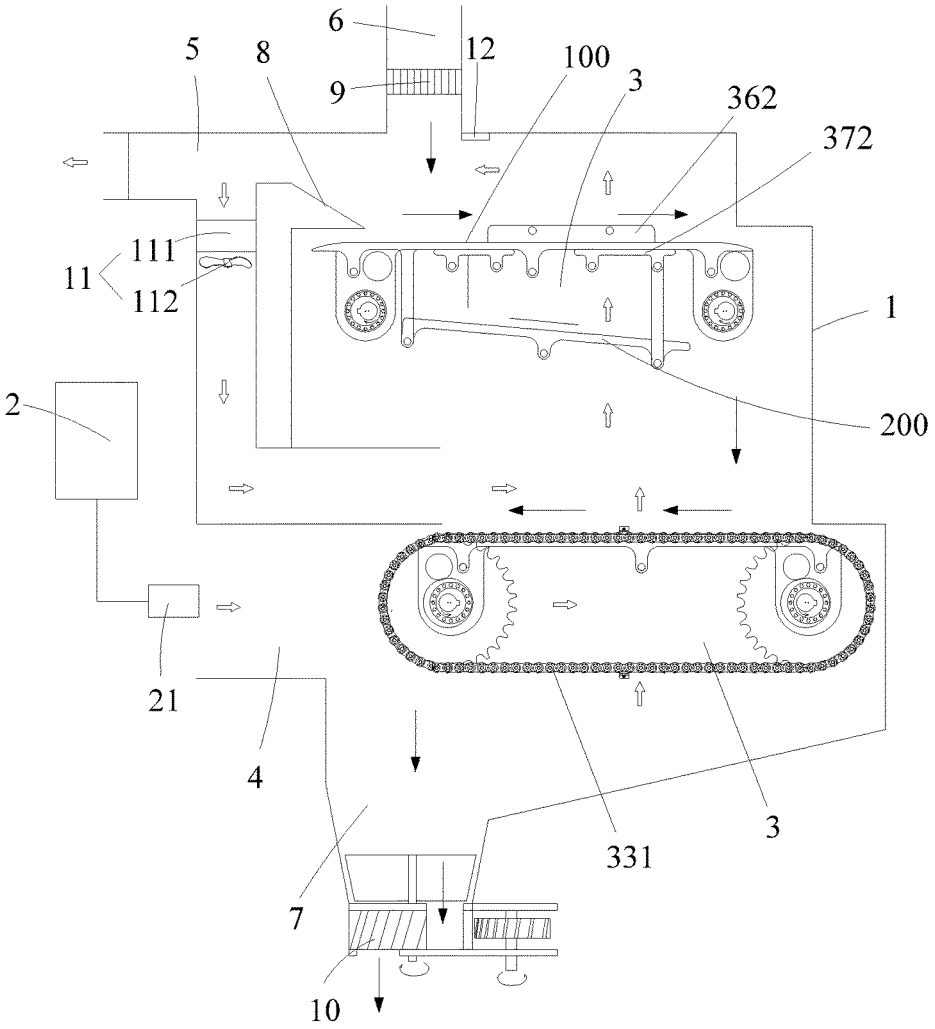
FIG. 1 schematically depicts a whole structure of a drying apparatus according to an embodiment of the present disclosure.
Figure 2:
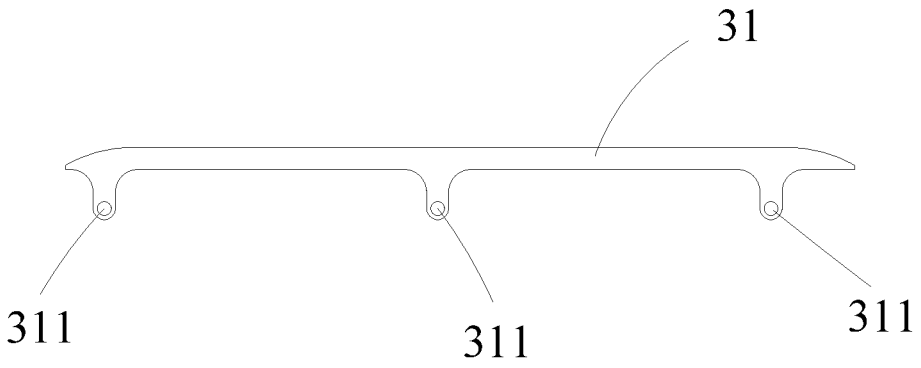
FIG. 2 schematically depicts a structure of a movable grid according to an embodiment of the present disclosure.
Figure 3:
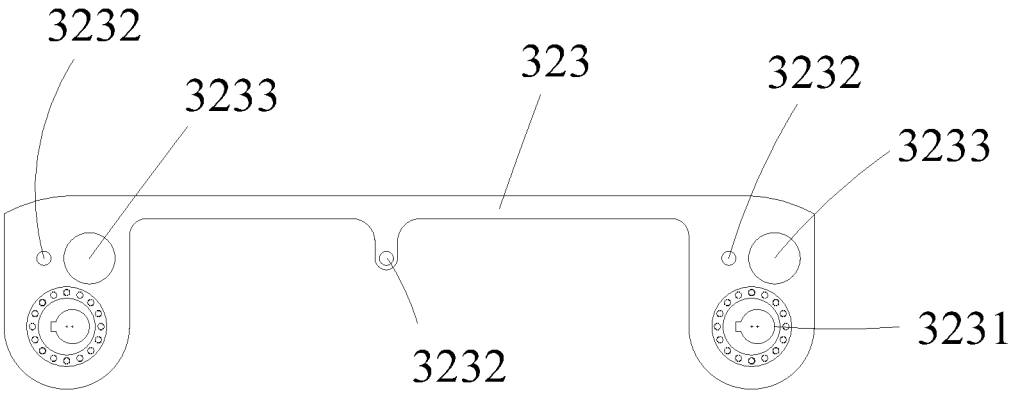
FIG. 3 schematically depicts a structure of a transmission gird according to an embodiment of the present disclosure.
Figure 4:
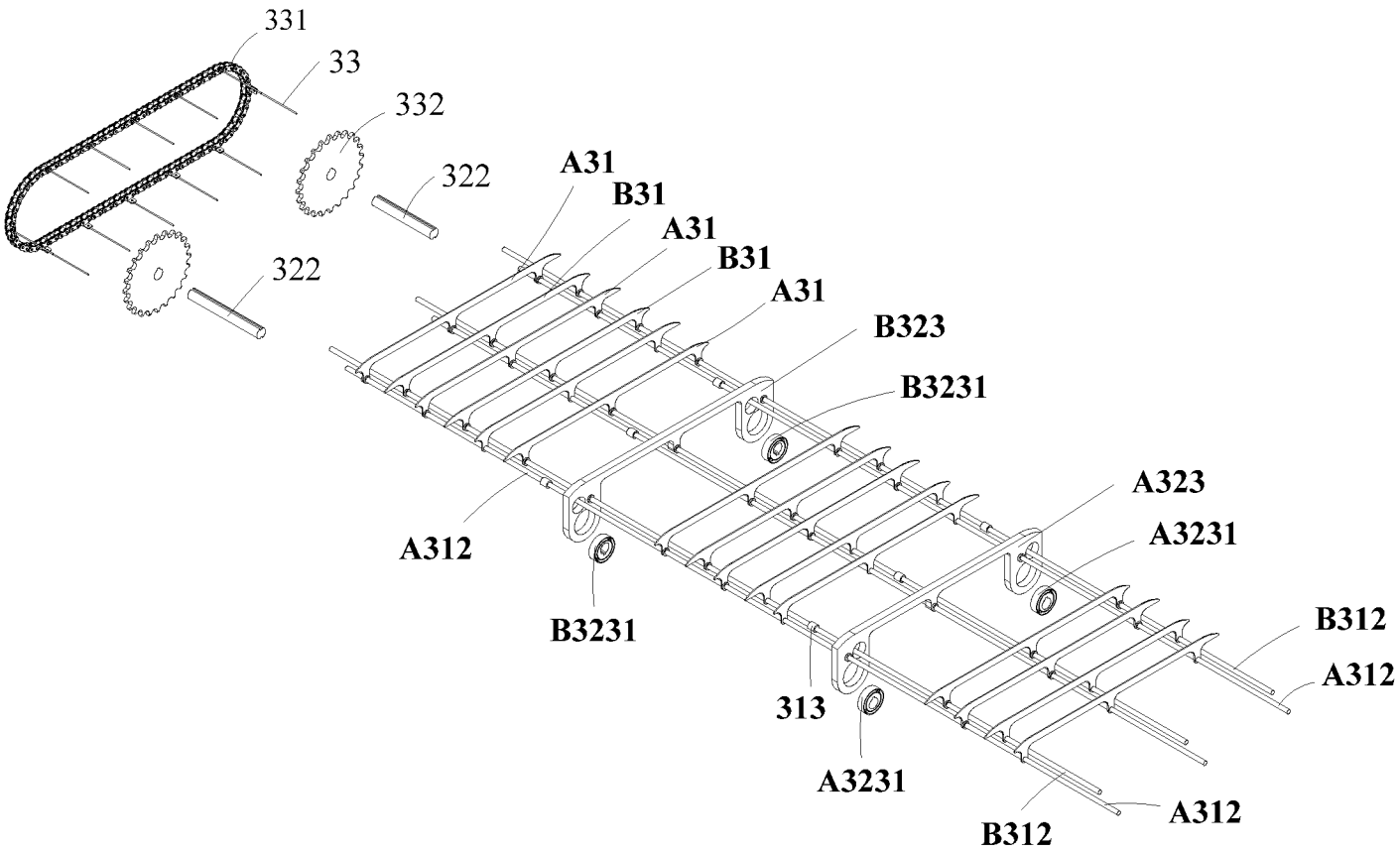
FIG. 4 is a partial three-dimensional exploded view of a conveying device according to an embodiment of the present disclosure.
Figure 5:
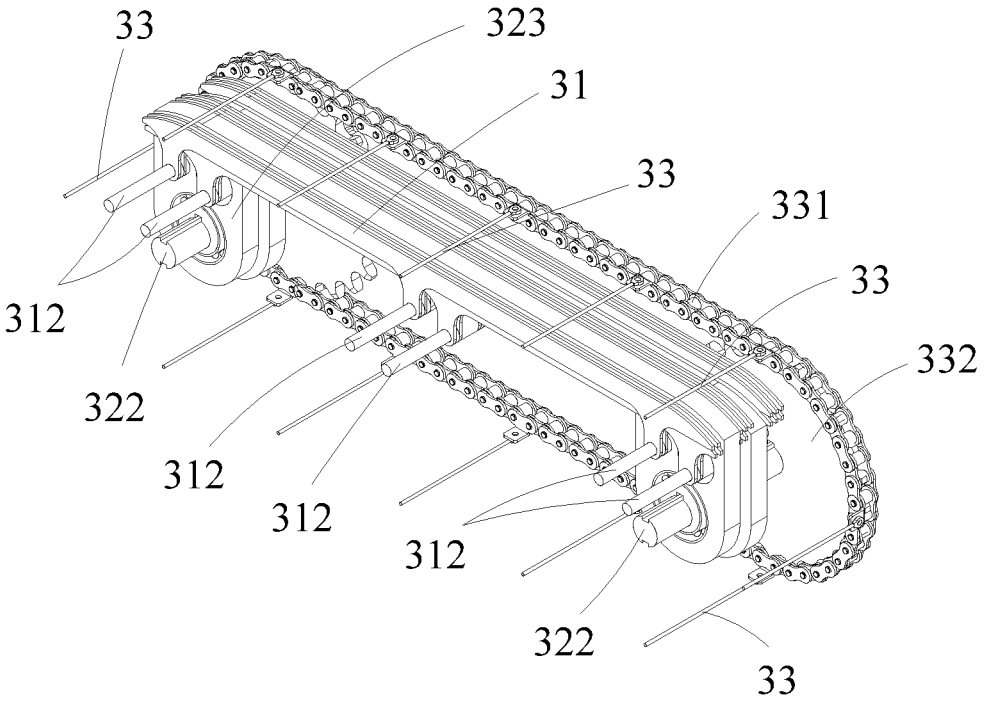
FIG. 5 schematically depicts a partial combination structure of the conveying device according to an embodiment of the present disclosure.
Figure 6:
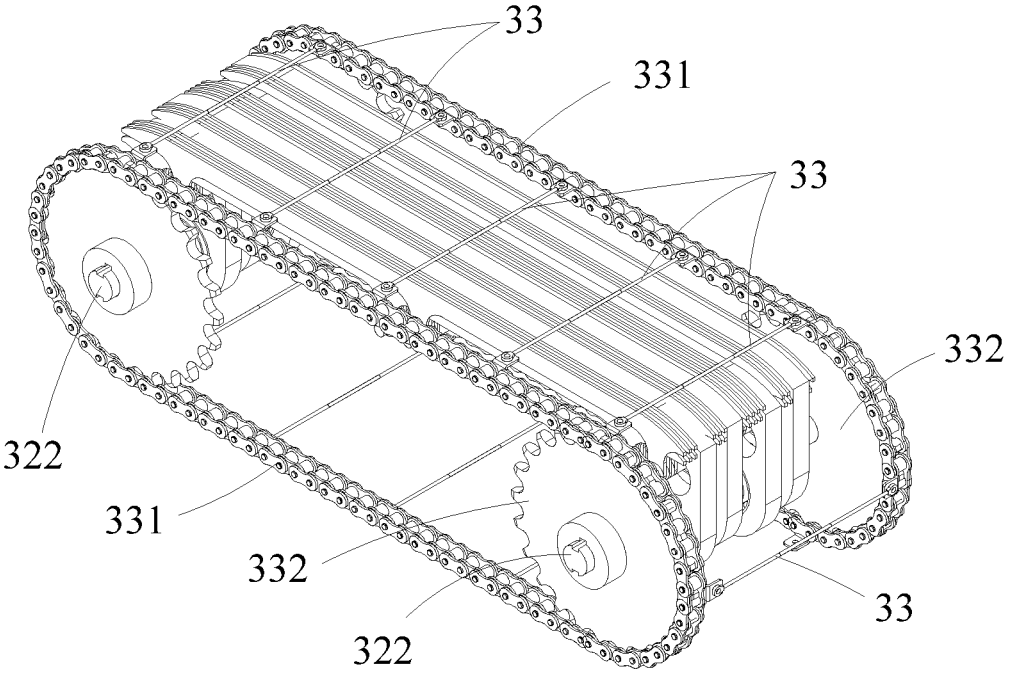
FIG. 6 schematically depicts a whole structure of the conveying device according to an embodiment of the present disclosure.
Figure 7:
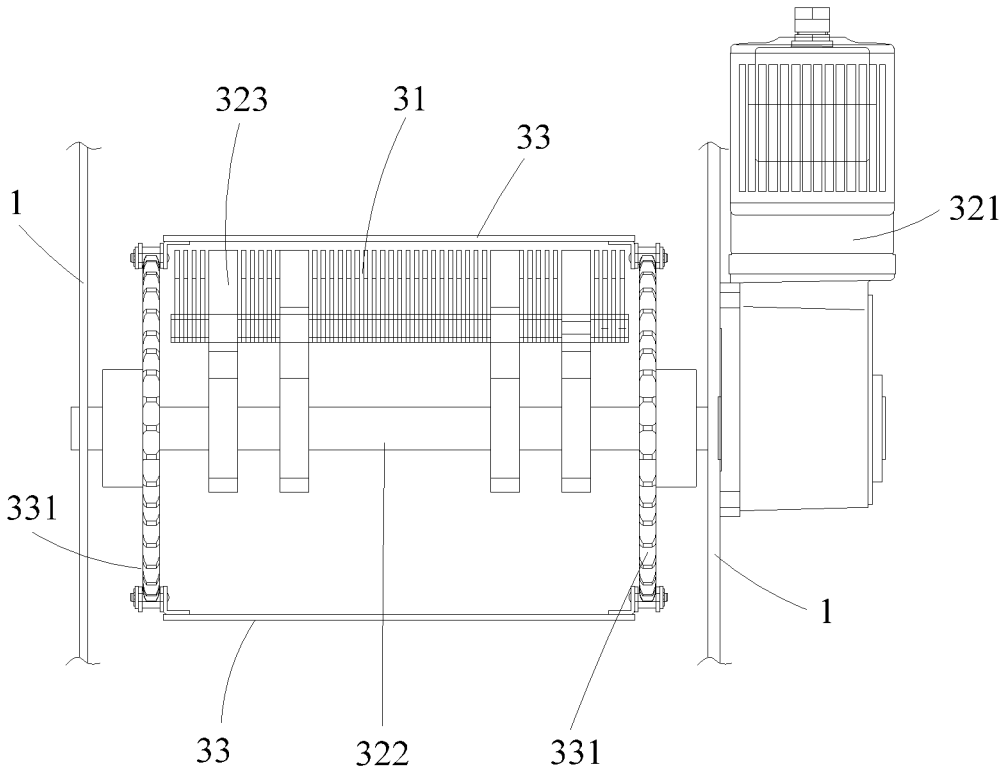
FIG. 7 is a side view of the conveying device according to an embodiment of the present disclosure.
Figure 8:
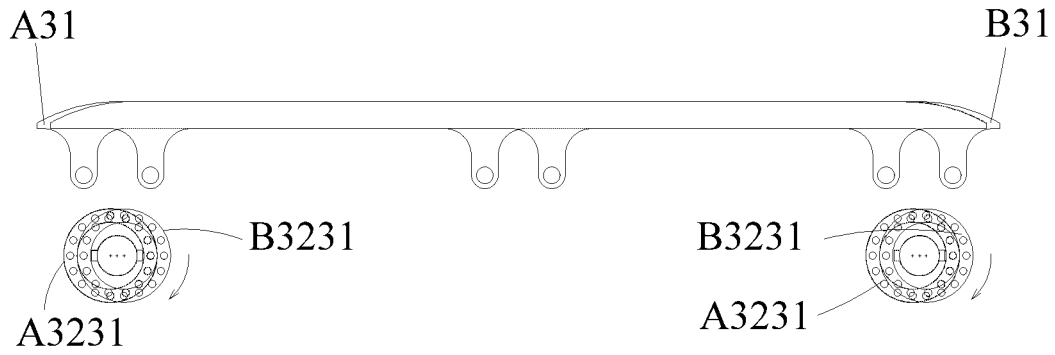
FIG. 8 schematically depicts an operating status of two movable grid groups according to an embodiment of the present disclosure, where the movable grid group A moves forward, and the movable grid group B moves backward.
Figure 9:
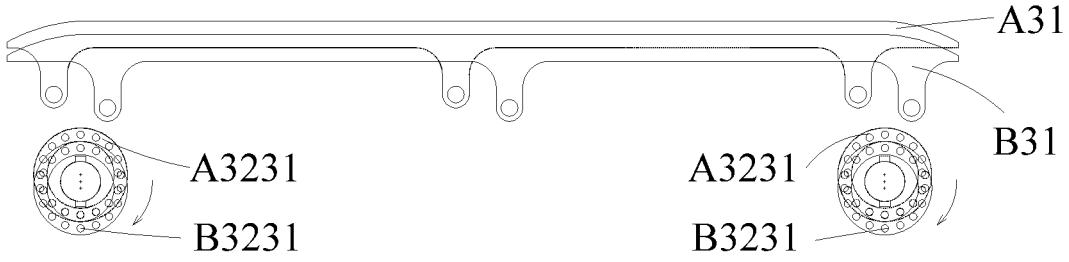
FIG. 9 schematically depicts an operating status of the two movable grid groups according to an embodiment of the present disclosure, where the movable grid group A moves upward, and the movable grid group B moves downward.
Figure 10:
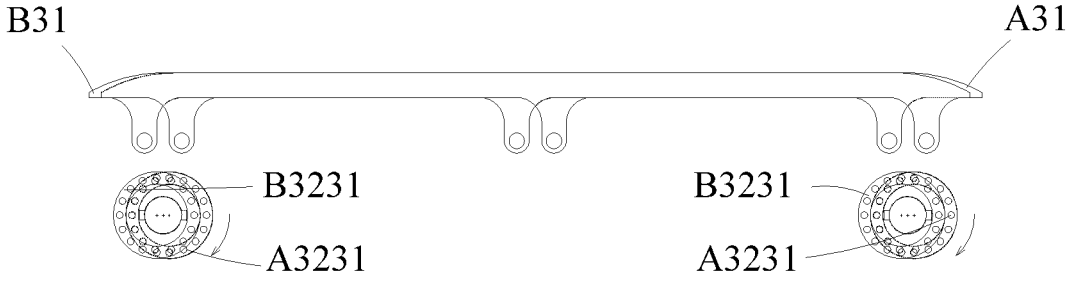
FIG. 10 schematically depicts an operating status of the two movable grid groups according to an embodiment of the present disclosure, where the movable grid group A moves backward, and the movable grid group B moves forward.
Figure 11:
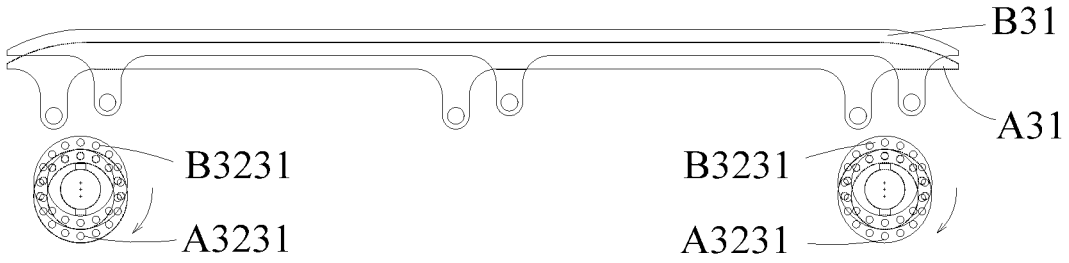
FIG. 11 schematically depicts an operating status of the two movable grid groups according to an embodiment of the present disclosure, where the movable grid group A moves downward, and the movable grid group B moves upward.

As shown in FIG. 1, an embodiment of the disclosure provides a drying apparatus based on peristaltic propelling, which includes a drying chamber 1, a heat supply module 2 and a conveying device 3.

The conveying device 3 is arranged in the drying chamber 1. The drying chamber 1 is provided with a heat source inlet 4, a heat source outlet 5, a feeding port 6 and a discharging port 7.

A heat output point 21 of the heat supply module 2 is arranged at the heat source inlet 4 and is configured to provide a heat source for the drying chamber 1. The heat supply module 2 is provided by a heat pump system.

The conveying device 3 includes two conveying devices 3. The two conveying devices 3 are layeredly arranged in the drying chamber from top to bottom. Conveying directions of conveying devices 3 of the two conveying devices 3 are opposite, such that the material is conveyed from an initial end to a tail end of a conveying device 3 at an upper layer, and then falls to an initial end of a conveying device 3 at a lower layer and then is conveyed to a tail end of the conveying device 3 at a lower layer, and is discharged through the discharging port 7.

The feeding port 6 is arranged above the conveying device 3 at an upper layer. The discharging port 7 is arranged blow the conveying device 3 at a lower layer.

An infrared heater 12 is provided above the conveying device 3 at an upper layer. The material is heated by the infrared heater 12, and allowed to enter the drying chamber 1 through the feeding port 6

The heat source inlet 4 is arranged at a side of the drying chamber 1 and near the discharging port 7. The heat source outlet 5 is arranged at the side of the drying chamber 1 and near the feeding port 6. A feeding direction of a heat source is opposite to a discharge direction of the material to be dried.

A guide plate 8 is arranged around a platform of the conveying device 3 to guide the heat source to the platform of the conveying device 3. A direction of a bottom plate arranged blow the drying chamber 1 is enable the material sliding down in a direction to the discharging port 7, either, the drying chamber is provided with an inclined sliding plate to enable the material sliding down in the direction to the discharging port 7.

A slivering machine 9 (or a slicing machine) is provided at the feeding port 6 to enable the material to be evenly scattered to an initial end of the conveying device 3 at an upper layer after being formed. The slivering machine 9 is configured to seal the feeding port 6 to prevent the heat source from leaking through the feeding port 6. The discharging port 7 is provided with a rotary feeder 10, which is a rotary feeder with continuous quantitative disclosed in the Chinese Patent Application No. 201611245704.0. In an embodiment, a rotating block of the rotary feeder 10 is a disk with gears, and the disk with gears is configured to be driven by another gear.

The drying chamber 1 further includes a heat source recycling device 11. The heat source recycling device 11 is arranged in the drying chamber 1 and near the heat source outlet 5. The heat source recycling device 11 includes a condenser 111 and a guide fan 112, such that a part of heat source is guided by a pipeline and the guide fan 112 to pass through the condenser 111 to be dehumidified, and then to return to the drying chamber 1.

As shown in FIGS. 2-7, the conveying device 3 includes a platform 100 formed through alternate stacking of two groups of grids 31.

The two groups of grids 31 both are movable grid groups. Adjacent two grids are capable of moving up and down and back and forth to enable the movable grid groups to reciprocate.

Each movable grid of the movable grid groups 31 is provided with three connecting holes 311 respectively at front and rear balance positions. Each of the movable grid groups 31 are connected to form a moving body through a connecting rod 312 penetratedly arranged in the three connecting holes 311. The moving body is configured to guide and drive all movable grids of a corresponding movable grid group 31 to move in the same trajectory through a drive device 32. Two adjacent grids 31 in the same group are separated by a gasket 313 to form a gap. The gasket 313 is arranged on the connecting rod 312.

The drive device 32 includes a drive motor 321, two chains 331, four sprocket wheels 332, two drive center shafts 322 and two transmission girds 323.

The drive motor 321 is arranged outside the drying chamber 1. Every two of the four sprocket wheels 332 are arranged at two ends of one of the two drive center shafts 322. The two chains 331 are respectively wound on the four sprocket wheels 332 placed in two sides of the two drive center shafts 322 to perform as a transmission mechanism between the two drive center shafts 322.

The two drive center shafts 322 are arranged at tow ends of the platform 100 front and rear symmetrical.

Two transmission girds 323 are symmetrically arranged at left and right symmetrical positions of the platform 100. Each of the two transmission girds 323 is provided with two eccentric bearings 3231, three fixing holes 3232 and two avoidance holes 3233 at the front and rear balanced positions.

Two ends of each of the two drive center shafts 322 are sleeved on the two eccentric bearings 3231 respectively, where the two eccentric bearings 3231 are arranged on the two transmission girds 323 left-right correspondingly. The connecting rod 312 is penetratedly arranged in the three fixing holes 3232.

The movable grid groups 31 include movable grid group A and movable grid group B. Movable grids A31 (multiple) of the movable grid group A are driven by transmission girds 323 (two) of a transmission gird group A to reciprocate upwards, forwards, downwards, backwards and upwards. Movable grids B31 (multiple) of the movable grid group B are driven by transmission girds 323 (two) of a transmission gird group B to reciprocate upwards, forwards, downwards, backwards and upwards. The movable grids A31 of the movable grid group A and the movable grids B31 of the movable grid group B is capable of staggered movement, of which a trajectory is determined by a rotation direction of the two drive center shafts 322, and a motion amplitude is determined by an eccentric wheelbase of the two eccentric bearings 3231.

The movable grids A31 of the movable grid group A and the movable grids B31 of the movable grid group B are configured to share the same drive central shaft group 322. A difference of an eccentric direction of the two eccentric bearings 3231 leads to the staggered movement between the movable grids A31 and the movable grids B31.

The drive motor 321 is configured to drive the two drive center shafts 322 to move synchronously through the two chains 331 and the four sprocket wheels 332 to enable the two drive center shafts 322, so as to drive the two transmission girds 323 sleeved on the two drive central shafts 322 to move, and the two transmission girds 323 is configured to drive movable grids of one movable grid group 31 connected with the two transmission girds 323 to move in the same trajectory.

In FIG. 1, the conveying device 3 at an upper layer is capable of utilizing two drive motors 321 to drive the two drive center shafts 322 respectively to move synchronously. The conveying device 3 at a lower layer is capable of utilizing one drive motor 321 to drive one of the two drive center shafts 322 directly, and is capable of utilizing two chains 331 and four sprocket wheels 332 to drive the other of the two drive center shafts 322 indirectly, so as to drive the two drive center shafts 322 move synchronously.

FIGS. 8-11 schematically depicts the two movable grid groups and eccentric bearings thereof under different operating statuses.

Surfaces of the movable grids A31 and the movable grids B31 can be designed to be serrated to enhance the friction during the transportation.

The platform 100 is capable of operating in both forward and reverse directions, where a distance of the forward operation is greater than a distance of the reverse operation, such that a conveying speed can be controlled when the material is conveyed from the initial end to the tail end of the conveying device 3.

Figure 12:
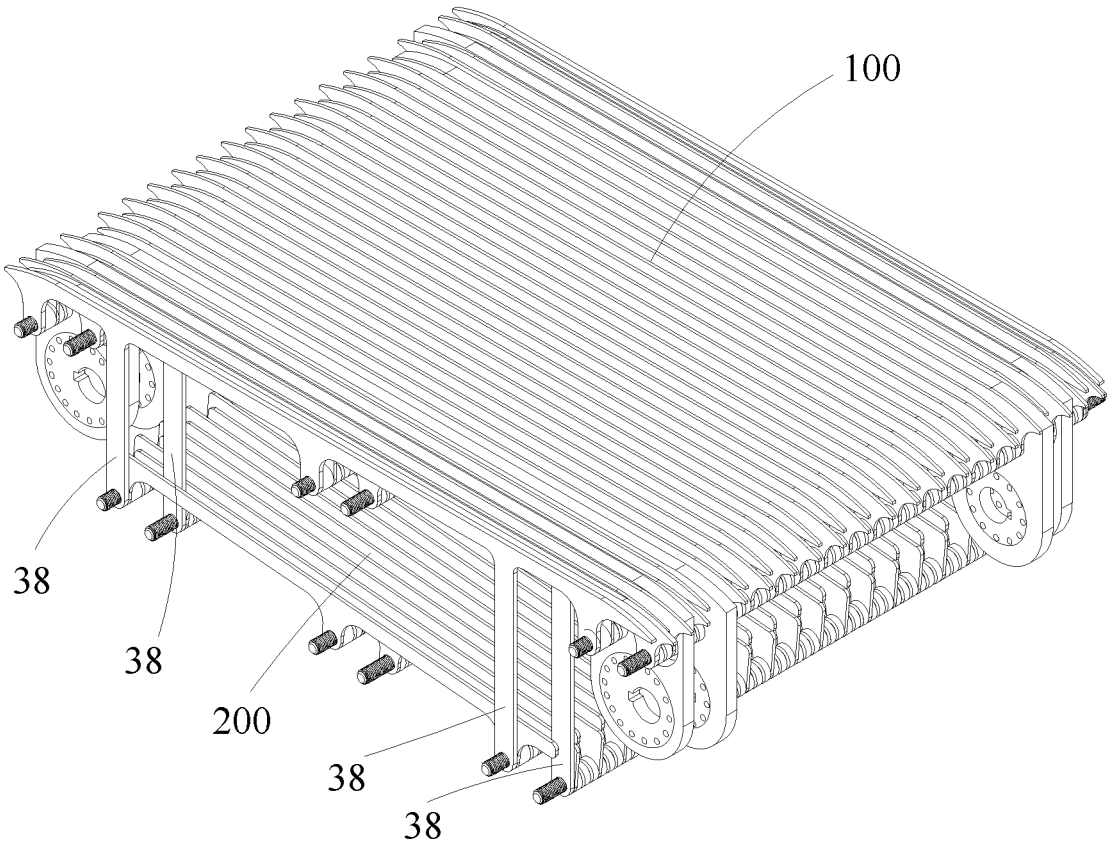
FIG. 12 schematically depicts a dual-platform structure of the conveying device according to an embodiment of the present disclosure.

In an embodiment, the conveying device 3 is further provided with a lower platform 200. The lower platform 200 is arranged blow the platform 100 and has the same structure with the platform 100. As shown in FIG. 12, the movable grids 31 of the movable grid group A of the platform 100 is connected to movable grids 2-31 of the lower platform 200 through a plurality of lower guide connecting bars 38, where the plurality of lower guide connecting bars 38 are evenly distributed on the movable grids 31 on two sides of the movable grid group A of the platform 100. The movable grids 31 of the movable grid group B are arranged by the same way. Based on this design, the movable grids 31 of the platform 100 drive corresponding movable grids 2-31 of the lower platform 200 to move in the same trajectory.

Due to the arrangement of the lower platform 200, a part of the material falling to the lower platform 200 through the gap of the platform 100 can be conveyed continuously, such that the platform 100 is extended, and the drying of the material is promoted.

The lower platform 200 are arranged inclined downward with respect to the conveying direction to facilitate a continuous conveying. Similarly, the platform 100 are arranged inclined downward with respect to the conveying direction.

A pressing device is arranged above the conveying device 3, and four embodiments of the pressing device are described as follows.

Embodiment 1 of the Pressing Device

Referring to FIGS. 4-7, the pressing device is a chain scraper, which includes multiple scraping bars 33.

The scraping bars 33 are provided spaced apart and located above the movable grid 31 to enable the material to be dried on the movable grid group 31 to be fully scraped when the movable grid group 31 moves up to a highest point, such that the material to be dried is flattened, pressed and pushed.

Embodiment 2 of the Pressing Device

Figure 13:
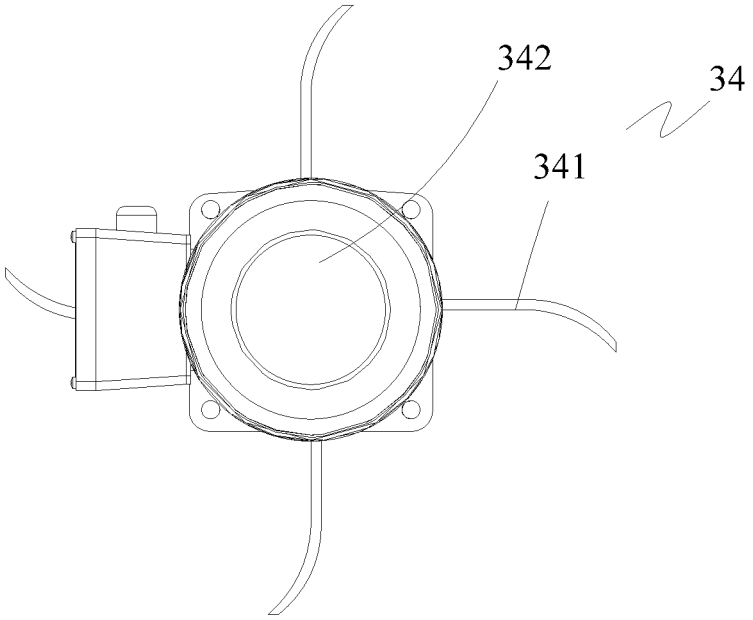
FIG. 13 is a top view of a rotating device according to an embodiment of the present disclosure.
Figure 14:
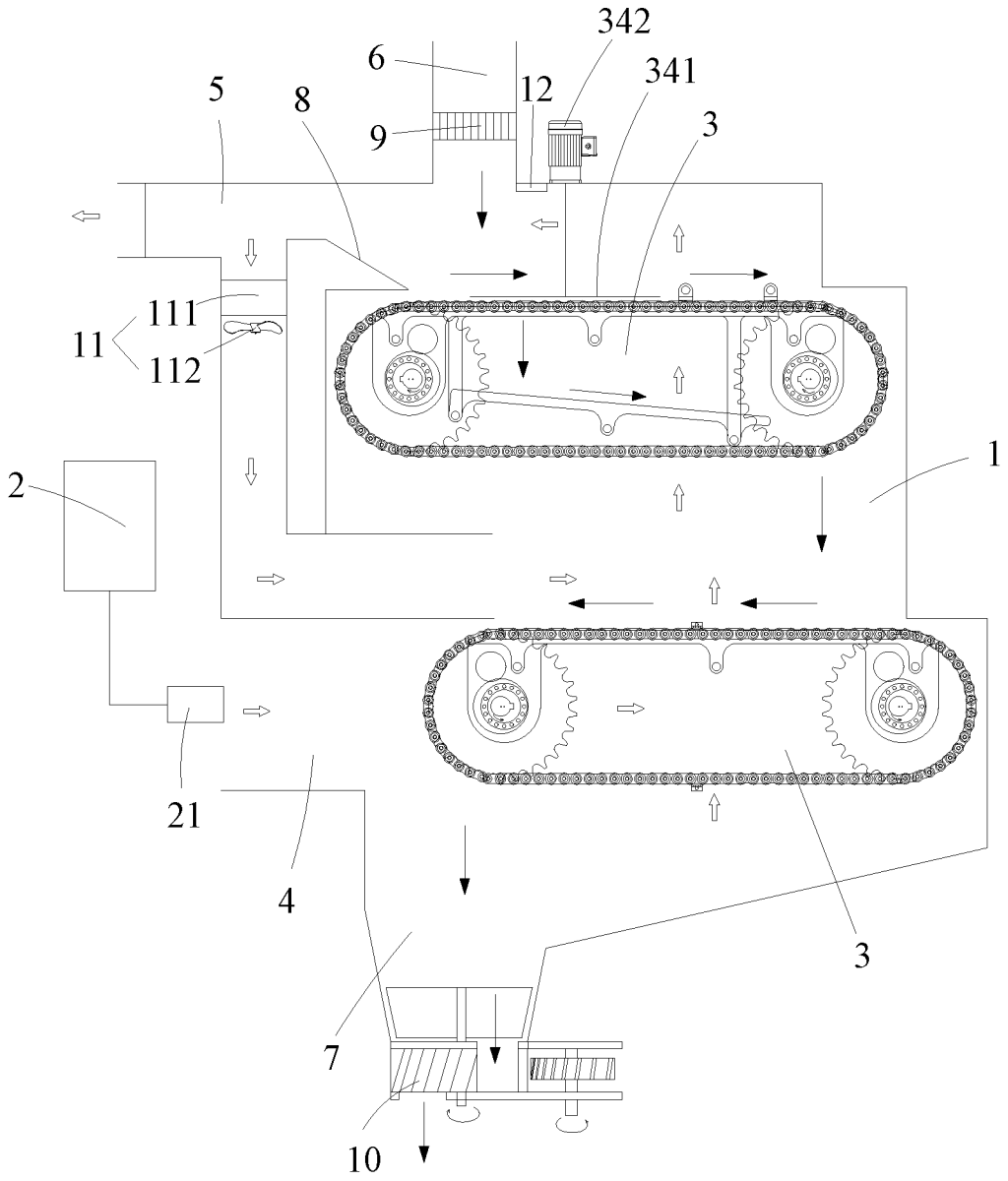
FIG. 14 schematically depicts a whole structure of the apparatus with the rotating device according to an embodiment of the present disclosure.

Referring to FIGS. 13 and 14, the pressing device is a rotating device 34, which includes a rotating pressing bar 341. The rotating pressing bar 341 is driven by a motor 342 placed outside the drying chamber 1 to rotate slowly. The rotating pressing bar 341 is placed above the movable grid group 31 to enable the material on the movable grid group 31 to be fully pressed by the rotating pressing bar 341 when the movable grid 31 moves up to a highest point, such that the material is flattened, pressed and scraped.

Embodiment 3 of the Pressing Device

Figure 15:
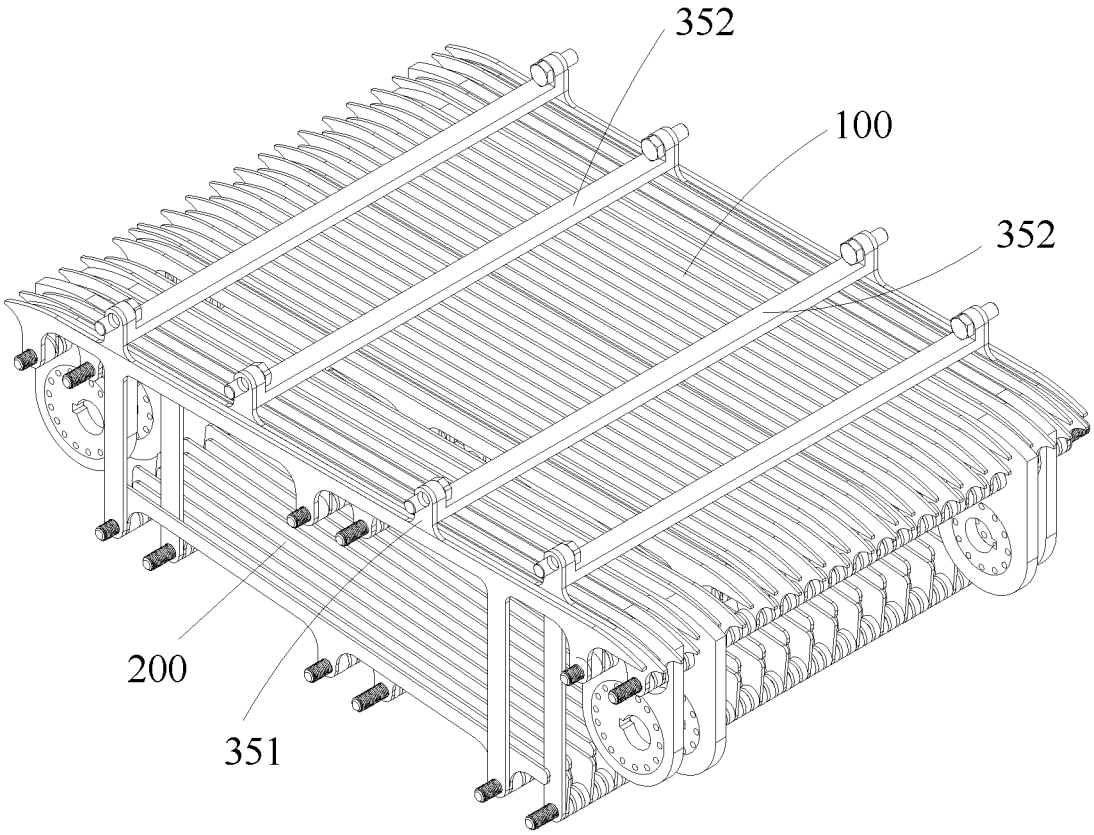
FIG. 15 schematically depicts a structure of a platform of the conveying device with a pressing plate according to an embodiment of the present disclosure.
Figure 16:
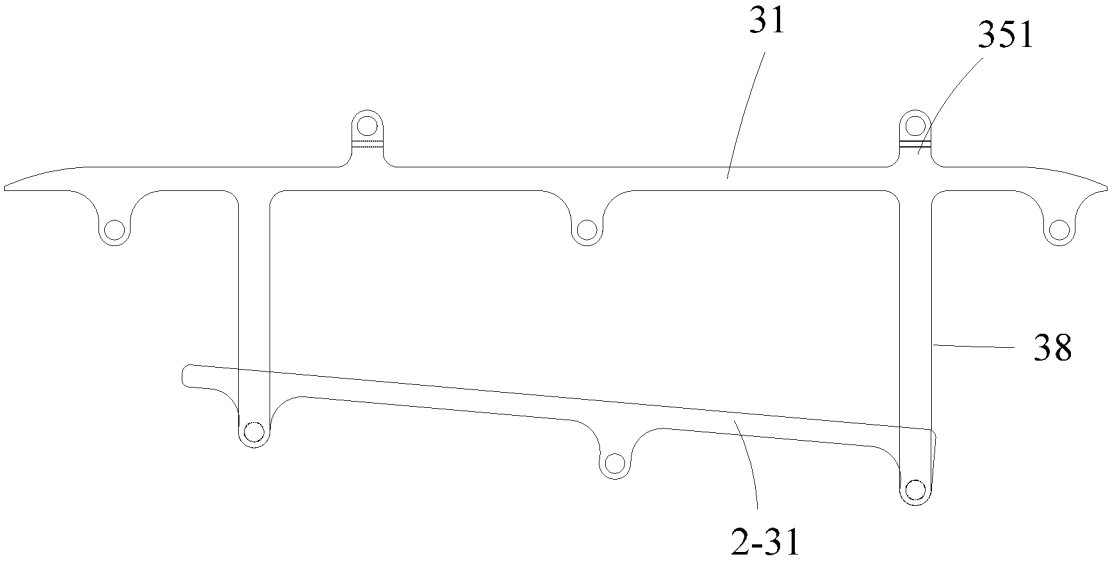
FIG. 16 schematically depicts a structure of the movable grid connected to the pressing plate according to an embodiment of the present disclosure.

Referring to FIGS. 15 and 16, the pressing device includes a plurality of pressing plates 352, which are arranged above the platform 100 through multiple upper guide connecting bars 351, such that the material can be fully pressed by the pressing plates 352 when the movable grid group B moves up to a highest point, achieving the flattening, pressing and scraping of the material. The upper guide connecting bars 351 are arranged on the movable grids on two sides of the movable grid group A.

The pressing plates 352 can be arranged spaced apart, and can be either arranged above one movable grid group, or arranged above two movable grid groups. As depicted in FIG. 15, the pressing plates 352 are arranged above both the movable grid group A and the movable grid group B.

Embodiment 4 of the Pressing Device

Figure 17:
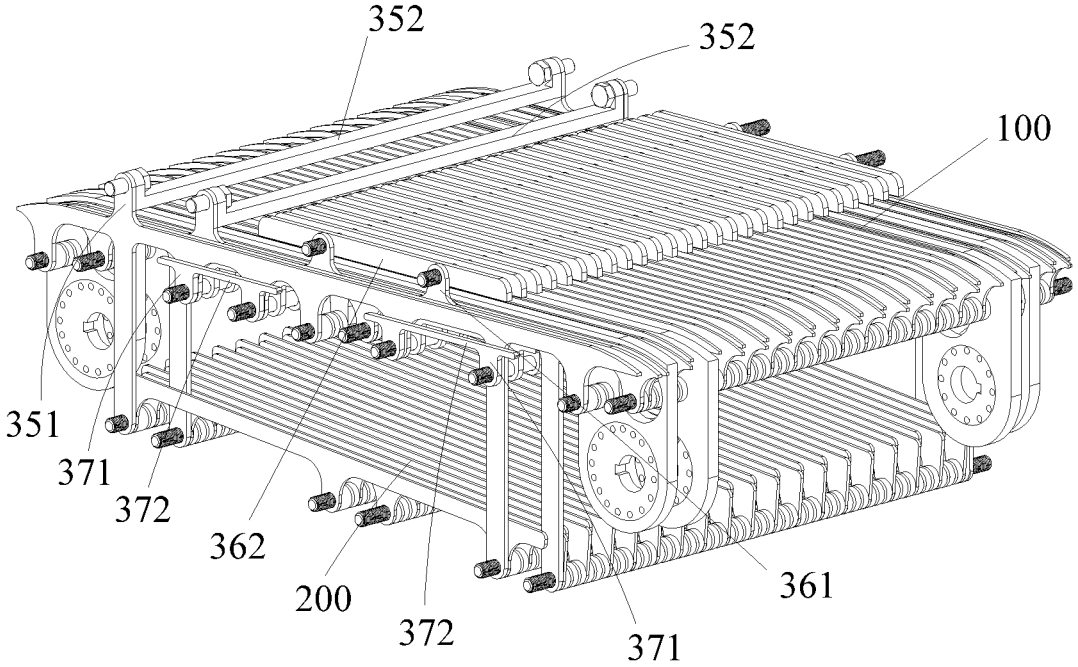
FIG. 17 schematically depicts a structure of the platform of the conveying device according to an embodiment of the present disclosure, where various pressing devices and scraping devices are used.
Figure 18:
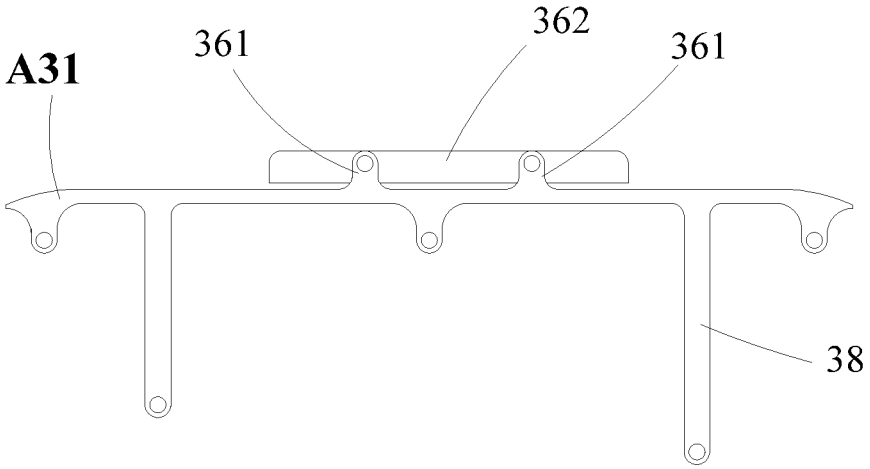
FIG. 18 schematically depicts a structure of the movable grid connected to a pressing grid according to an embodiment of the present disclosure.

Referring to FIGS. 17 and 18, the pressing device includes a pressing grid group 362.

The pressing grid group 362 is connected above the platform 100 through a plurality of upper guide connecting rods 361. The plurality of upper guide connecting rods 361 are balancedly arranged on movable grids on two sides of the movable grid group A of the platform 100. The pressing grid group 362 is driven to move by a movement of the movable grid group A of the platform 100. Moreover, pressing grids of the pressing grid group 362 are respectively aligned with gaps of the movable grid group B to enable the pressing grid group 362 to scrape a side wall of the movable grid group B and press the material to be dried, such that the material is flattened, sheared, pressed and scraped.

The pressing device is selected from the above four embodiments or a combination of Embodiment 2, Embodiment 3 and Embodiment 4.

Figure 19:
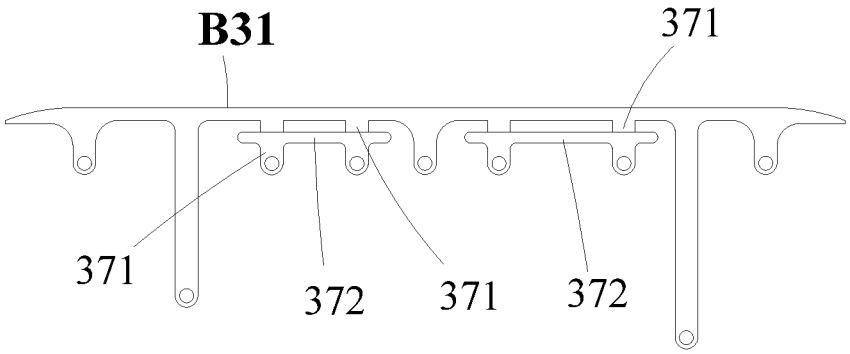
FIG. 19 schematically depicts a structure of the movable grid connected to a scraping grid according to an embodiment of the present disclosure.

Referring to FIG. 19, a scraping device 37 is further arranged below the platform 100. The scraping device 37 includes a scraping grid group 372. The scraping grid group 372 is connected below the platform 100 through a plurality of lower guide connecting rods 371. The plurality of lower guide connecting rods 371 are balancedly arranged on movable grids on two sides of the movable grid group B. The scraping grid group 372 is driven by a movement of the movable grid group B to move. Moreover, scraping grids of the scraping grid group 372 are respectively with gaps of the moving group A to enable the scraping grid group 372 scraping aside wall of the grid group A, such that the material is pressed and scraped.

In an embodiment, multiple scraping devices 37 can be provided.

The scraping device 37 can be simultaneously used with any one of pressing devices in the above four embodiments. In an embodiment, the scraping device 37 and the pressing device 36 of Embodiment 4 are used simultaneously. It should be noted that the scraping grid group 372 must be connected below the movable grid group B when the pressing grid group 362 is connected above the movable grid group A of the platform 100, such that the pressing grid group 362 can scrap the side wall of the movable grid group B when moves downwards and the scraping grid group 372 can scrape a side wall of the moving group A when moves upwards. Therefore, the side wall of the moving group A and the side wall of the moving group B are both scraped and the material can be flattened when the pressing grid group 362 moves downwards. FIG. 17 schematically depicts a structure of the platform of the conveying device with a pressing block, pressing grid and two scraping devices.

The pressing device in Embodiment 3, the pressing device in Embodiment 4 and the scraping device 37 can be arranged on the lower platform 200.

A work process of the drying apparatus provided herein is described as follows.

A material is fed to the drying chamber 1 through the slivering machine 9 at the feeding port 6 and falls to the initial end of the conveying device 3 at an upper layer. The material is conveyed from the initial end to the tail end of the conveying device 3 at an upper layer, then is capable of falling to an initial end of the conveying device 3 at a lower layer and is conveyed to a tail end of the conveying device 3 at a lower layer. After that, the material is capable of falling to the discharging port 7 and is discharged by the rotary feeder 10. The slivering machine 9 and the rotary feeder 10 are configured seal the feeding port 6 and the discharging port 7 to prevent the heat source from leaking through the feeding port 6 and the discharging port 7.

Meanwhile, the heat source is fed to the drying chamber 1 from the heat source inlet 4, penetrates a bottom of the conveying device 3 at a lower layer to rise and then penetrates a bottom of the conveying device 3 at an upper layer to rise to reach the heat source outlet 5. Due to the heat source recycling device 11, a part of the heat source is guided by a pipeline and the guide fan 112 to be dehumidified by the condenser 111 and then to return to the drying chamber 1.

The rising of the heat source conforms to the physical principle. Actually, the evaporation is mainly for rendering the material uniform. The penetration through the material requires the air flow, and the material surface also needs the air flow for a faster evaporation. In the conveying process, grids are capable of creating gaps to improve a fluidity of air. Moreover, an evaporation area of the material is expanded by propping up, flattening, shearing, scraping and so on, rendering the drying process more efficient. The material can fall down from the gaps without causing blockage. The lower platform is configured to extend the platform, therefore benefiting the drying of the material. A feeding direction of the heat source is opposite to a discharge direction of the material. The heat source is introduced to the drying chamber from a horizontal direction, and then not only rises from the bottom of the platform of the conveying device, but also flows in the horizontal direction, which removes the water from the material by evaporation and enhances the evaporation efficiency. The feeding port is sealed to prevent the leakage of the heat source, further enhancing the evaporation efficiency.

The embodiments mentioned above are merely preferred embodiments of this disclosure, and not intended to limit the scope of the present disclosure. It should be understood that any changes, modifications and variations made by those killed in the art without departing from the spirit of this disclosure should fall within the scope of the present disclosure defined by the appended claims.

What is claimed is:

1. A drying apparatus based on peristaltic propelling, comprising:

a heat supply module;

a drying chamber; and a conveying device;

wherein the conveying device is arranged in the drying chamber; the drying chamber is provided with a heat source inlet, a heat source outlet, a feeding port and a discharging port;

a heat output point of the heat supply module is arranged at the heat source inlet and is configured to provide a heat source for the drying chamber;

the conveying device is configured to provide a platform for laying and propelling a material to be dried; and the platform of the conveying device is formed by laying a plurality of main parts capable of generating relative local movement and displacement; a gap is provided between adjacent two main parts to allow air to pass through; and the plurality of main parts are configured to repeatedly flip the material to be dried to enable peristaltic propelling of the material to be dried and keep the gap unobstructed;

wherein each of the plurality of main parts comprises a conveying sub-platform; the conveying sub-platform is formed through alternate stacking of at least two groups of first grids; two adjacent first grids in the same group are separated by a gasket; and a thickness of the gasket is greater than that of first grids in another group of the at least two groups of first grids to form the gap;

the at least two groups of first grids comprise at least one movable grid group, and the at least one movable grid group is capable of generating relative displacement with respect to another group of the at least two grid groups, so as to enable the at least one movable grid group to reciprocate; and each movable grid of each of the at least one movable grid group is provided with at least two connecting holes respectively at front and rear balance positions;

movable grids of each of the at least one movable grid group are connected to form a moving body through a connecting rod penetratedly arranged in the connecting holes;

and the moving body is configured to guide and drive all movable grids of a corresponding movable grid group to move in the same trajectory through a drive device.

2. The drying apparatus of claim 1, wherein the drive device comprises a drive central shaft group, a transmission gird group and a drive mechanism group;

the drive central shaft group comprises at least two drive central shafts;

the transmission gird group comprises at least two transmission girds respectively provided at left and right balance positions of the conveying sub-platform;

each of the at least two transmission girds is provided with at least two eccentric devices at front and rear balance positions of the conveying sub-platform; one of the at least two drive central shafts is penetratedly provided in left-right corresponding eccentric devices of the transmission gird group; the eccentric devices of the transmission gird group have consistent eccentric direction and eccentric wheelbase;

each of the at least two transmission girds is provided with at least two fixing holes;

the at least two fixing holes are arranged respectively corresponding to the connecting holes of the movable grid group; and each of the at least two fixing holes and a corresponding connecting hole are fixedly connected through the same connecting rod;

the drive mechanism group comprises one drive motor and a transmission mechanism, or a plurality of drive motors; and the drive mechanism group is configured to drive the at least two drive central shafts of the drive central shaft group to rotate at the same rotation direction and rotation speed; and the drive mechanism group is configured to drive the at least two drive central shafts of the drive central shaft group to move synchronously, so as to drive the at least two transmission girds respectively sleeved on the at least two drive central shafts to move; and the transmission gird group is configured to drive one movable grid group connected with the transmission gird group to move in the same trajectory.

3. The drying apparatus of claim 2, wherein the conveying sub-platform is formed through alternate stacking of two movable grid groups; the two movable grid groups are configured to share the same drive central shaft group.

4. The drying apparatus of claim 1, wherein a lower platform is correspondingly provided below the platform of the conveying device; the lower platform is formed through alternate stacking of at least two groups of second grids; and a gap is provided between adjacent two second grids; and each of the at least one movable grid group of the platform of the conveying device is connected to a movable grid group of the lower platform through a plurality of lower guide connecting bars, such that the movable grid group of the lower platform and a corresponding movable grid group of the platform of the conveying device move in the same trajectory; and the plurality of lower guide connecting bars are evenly distributed on movable grids on two sides of each of the at least one movable grid group of the platform of the conveying device.

5. The drying apparatus of claim 1, wherein a pressing device is arranged above the platform of the conveying device.

6. The drying apparatus of claim 5, wherein the pressing device is a rotating device, and is placed above the at least one movable grid group of the platform of the conveying device to enable the material to be dried on the at least one movable grid group to be pressed by the rotating device when the at least one movable grid group moves up to a highest point, such that the material to be dried is flattened, pressed and scraped.

7. The drying apparatus of claim 5, wherein the pressing device comprises at least one pressing plate; the at least one pressing plate is arranged above one of the at least one movable grid group of the platform of the conveying device through a plurality of upper guide connecting bars, such that the material to be dried is fully pressed by the plurality of upper guide connecting bars when another group of the at least one movable grid group moves up to a highest point, enabling the material to be dried to be flattened, pressed and scraped; and the plurality of upper guide connecting bars are balancedly arranged on movable grids on two sides of the one of the at least one movable grid group of the platform of the conveying device.

8. The drying apparatus of claim 5, wherein the pressing device is a chain scraper;

the chain scraper is a scraping bar arranged on a transmission mechanism;

the transmission mechanism comprises at least two chains and at least four sprocket wheels; every two of the at least four sprocket wheels are arranged on one of at least two drive central shafts; each of the at least two chains is wound on at least two of the at least four sprocket wheels; and the scraping bar comprises at least one scraping bar; the at least one scraping bar is provided on each of the at least two chains; the at least one scraping bar is located above the at least one movable grid group of the platform of the conveying device to enable the material to be dried on the at least one movable grid group of the platform of the conveying device to be fully scraped when the at least one movable grid group moves up to a highest point, such that the material to be dried is flattened, pressed and scraped; and when the number of the at least one scraping bar is large than or equal to two, the at least one scraping bar is arranged spaced apart.

9. The drying apparatus of claim 5, wherein the pressing device comprises a pressing grid group; the at least one movable grid group of the platform of the conveying device comprises a first movable grid group and a second movable grid group; the pressing grid group is connected above the platform of the conveying device through a plurality of upper guide connecting rods; the plurality of upper guide connecting rods are balancedly arranged on movable grids on two sides of the first movable grid group; the pressing grid group is driven to move by a movement of the first movable grid group; pressing grids of the pressing grid group are respectively aligned with gaps of the second movable grid group to enable the pressing grid group to scrape a side wall of the second movable grid group and press the material to be dried, such that the material to be dried is flattened, sheared, pressed and scraped.

10. The drying apparatus of claim 1, wherein a scraping device is arranged below the platform of the conveying device; and the scraping device comprises a scraping grid group; the scraping grid group is connected below the platform of the conveying device through a plurality of lower guide connecting rods; the plurality of lower guide connecting rods are balancedly arranged on movable grids on two sides of the second movable grid group; the scraping grid group is driven by a movement of the second movable grid group to move; scraping grids of the scraping grid group are respectively aligned with gaps of the first movable grid group to enable the scraping grid group to scrape a side wall of the first movable grid group, such that the material to be dried is pressed and scraped.

* * * * *